US008096558B2

(12) United States Patent
Curcija

(10) Patent No.: US 8,096,558 B2
(45) Date of Patent: Jan. 17, 2012

(54) DART BOARD APPARATUS

(76) Inventor: Joseph Curcija, Oakville (CA)

( * ) Notice: Subject to any disclaimer, the term of this patent is extended or adjusted under 35 U.S.C. 154(b) by 150 days.

(21) Appl. No.: 12/707,929

(22) Filed: Feb. 18, 2010

(65) Prior Publication Data

US 2011/0049808 A1 Mar. 3, 2011

Related U.S. Application Data

(60) Provisional application No. 61/237,722, filed on Aug. 28, 2009.

(51) Int. Cl.
*F41J 3/00* (2006.01)

(52) U.S. Cl. ..... 273/408; 273/409; 273/371

(58) Field of Classification Search ..... 273/403, 273/404, 408, 409, 371–377, 247, 277
See application file for complete search history.

(56) References Cited

U.S. PATENT DOCUMENTS

| | | | | | |
|---|---|---|---|---|---|
| 2,064,466 | A | | 12/1936 | Downey | |
| 2,106,846 | A | | 2/1938 | Katz | |
| 2,227,382 | A | * | 12/1940 | Salter | 273/409 |
| 2,587,242 | A | * | 2/1952 | Stringer | 273/247 |
| 3,504,913 | A | * | 4/1970 | Bilotti | 273/407 |
| 3,979,117 | A | | 9/1976 | Worsham | |
| D287,144 | S | * | 12/1986 | Dunn | D21/307 |
| 4,681,325 | A | | 7/1987 | Sheem | |
| 4,893,822 | A | * | 1/1990 | Tesa et al. | 273/376 |
| 5,005,842 | A | | 4/1991 | Bauer | |
| 5,066,020 | A | | 11/1991 | Trudeau | |
| 5,401,033 | A | * | 3/1995 | Lychock, Jr. | 273/371 |
| 5,664,782 | A | | 9/1997 | Lacks et al. | |
| 5,711,527 | A | | 1/1998 | Phalin et al. | |
| 5,967,518 | A | * | 10/1999 | Rowe | 273/317.5 |
| 6,402,154 | B1 | | 6/2002 | Hess et al. | |
| 7,806,409 | B1 | * | 10/2010 | Cardenas | 273/371 |
| 2005/0062232 | A1 | | 3/2005 | Pavlik et al. | |
| 2008/0234021 | A1 | * | 9/2008 | Palmer et al. | 463/2 |

* cited by examiner

*Primary Examiner* — Mark Graham
(74) *Attorney, Agent, or Firm* — Young Basile Hanlon & MacFarlane PC

(57) ABSTRACT

This is a game combining darts, a game board, a non-standard dartboard, and non-standard cards to simulate a football game. The dartboard includes a center scoring region at the center of the dartboard, concentric rings of varying radii surrounding the center scoring region, and multiple scoring regions within each ring labeled with either a yardage target label or an alphabetic label describing a state of play. The cards include starting yard line cards, yard line cards, red zone cards, interception or fumble cards, and penalty cards. The yard line cards indicate on one side of each card a yard range on a simulated football field corresponding to a player's position on this field and on an opposite side of each card a plurality of yardage targets to be achieved by the player by means of darts thrown at the dart board.

23 Claims, 11 Drawing Sheets

RED ZONE CARD

| | | | | |
|---|---|---|---|---|
| 20 – | 6 4 YD PASS, | 14 7 YD PASS, | 1 5 YD RUN, | 2 3 YD PASS |
| 19 – | 17 6 YD RUN, | 16 1 YD PASS, | 5 8 YD RUN, | 13 2 YD RUN |
| 18 – | 4 9 YD PASS, | 2 3 YD PASS, | 15 4 YD RUN, | 7 1 YD RUN |
| 17 – | RED ZONE | RED ZONE | RED ZONE | |
| 16 – | 13 2 YD RUN, | 1 5 YD RUN, | 12 6 YD PASS, | 11 3 YD RUN |
| 15 – | 2 3 YD PASS, | 15 4 YD RUN, | 20 2 YD PASS, | 17 6 YD RUN |
| 14 – | 15 4 YD RUN, | 7 1 YD RUN, | 6 5 YD PASS, | 2 3 YD PASS |
| 13 – | 1 5 YD RUN, | 16 1 YD PASS, | 15 4 YD RUN, | 13 2 YD RUN |
| 12 – | 20 2 YD PASS, | 1 5 YD RUN, | 7 1 YD RUN, | 6 4 YD PASS |
| 11 – | 6 4 YD PASS, | 13 2 YD RUN, | 11 3 YD RUN, | 16 1 YD PASS |

Figure 5B

DART BOARD APPARATUS

RELATED APPLICATION INFORMATION

This application claims priority to U.S. provisional application No. 61/237,722, filed on Aug. 28, 2009. The content of U.S. Provisional Patent Application Ser. No. 61/237,722 is incorporated herein by reference.

SUMMARY OF THE INVENTION

The present invention relates to a dart game, and in particular to a dart game that simulates a football game.

The game of darts, in which darts are thrown at a circular target (a dartboard), is known in the art. Darts are played informally in pubs and homes and professionally in tournaments around the world. A standard dartboard commonly used and known in the art is round and contains a bull's ring, a bull's eye, multiple pie sections, a double ring, a triple ring, and numeric markings along the outer perimeter formed by the pie sections. The numeric markings denote score points, and in the standard dartboard are arranged clockwise from the top of the dartboard as "20 1 18 4 13 6 10 15 2 17 3 19 7 16 8 11 14 9 12 5".

Playing cards, used for playing card games, are known in the art. Many varieties of playing cards are known, examples of which include those used to play poker in casinos worldwide and those used in Monopoly™ board games.

However, the prior art does not disclose a game where darts are played with a non-standard dartboard as disclosed herein. The prior art also does not disclose a game where darts, a non-standard dartboard as disclosed herein and non-standard playing cards as disclosed herein are combined in the manner disclosed herein.

BRIEF SUMMARY OF THE DISCLOSURE

According to one aspect of the present invention, a dart game apparatus for simulating a football game using darts to be thrown by players includes a dart board on which is formed a target region capable of receiving and holding darts thrown by a player. The target region is divided into a center scoring region located at the center of the target region and at least first and second concentric rings surrounding the center scoring region. The first ring is divided into a plurality of first ring scoring regions and the second ring is divided into a plurality of second ring scoring regions. A plurality of yardage target labels are provided on the target region and a plurality of alphabetic labels also provided on the target region. Each alphabetic label denotes a state of play related to the simulated football game. The apparatus further includes a plurality of yard line cards indicating on one side of each card a yard range on a simulated football field corresponding to a player's position on this football field and on an opposite side of each card a plurality of yardage targets to be achieved by the player, who has selected that particular card, by means of darts thrown at the dart board. Each of the first and second scoring regions displays either one of the yardage target labels or one of the alphabetic labels.

An exemplary version of this game apparatus includes a third concentric ring surrounding the center scoring region and divided into a plurality of third ring scoring regions. Each third ring scoring region displays one of the yardage target labels.

According to another embodiment of the invention, a dart game apparatus for simulating a football game using darts to be thrown by players includes a dart target on which is provided a target area capable of holding the darts thrown by each player. The target area is divided by a center scoring region located centrally on the target area and at least first and second concentric rings surrounding the central scoring region. The first ring is divided in a plurality of first ring scoring regions arranged around the first ring and the second ring is divided into a plurality of second ring scoring regions arranged around the second ring. A plurality of yardage target labels are provided on the target area and also a plurality of alphabetic labels are provided on the target area. The latter labels denote states of play related to the simulated football game. Each of the first and second ring scoring regions display either one of the yardage target labels or one of the alphabetic labels. The apparatus further includes random selection means for providing in a random manner a set of yardage targets to be achieved by each player on his or her turn for throwing a dart or darts at the dart target.

In an exemplary version of this dart game apparatus, the random selection means is a deck of cards each of which indicates on a front side of the card a yard range on a simulated football field and indicates on the rear side a plurality of yardage targets to be achieved by throwing darts.

In an exemplary version, there is an outermost annular area on the target area displaying a series of consecutive numbers ranging from "1" to a maximum number corresponding to the total number of second ring scoring regions.

According to yet another embodiment of the invention, a dart game apparatus for simulating a football game using darts to be thrown by players includes a dart target on which is provided a target area capable of holding darts thrown by each player. The target area is divided into a plurality of scoring regions. A plurality of yardage target labels are distributed over the target area and a plurality of additional labels are distributed over the target area, these denoting states of play related to the simulated football game. At least the majority of the scoring regions each have either one of the yardage target labels or one of the additional labels. Some of the additional labels denote a "fumble" state of play and some of the additional labels denote an "interception" state of play. The apparatus further includes first and second random selection means for use by the players. The first random selection means provides in a random manner a set of yardage targets to be achieved by each player on his or her turn for throwing a dart or darts at the dart target. The second random selection means provides in a random manner a starting yardage position to which a player must move during the play of the game after the player hits one of the scoring regions with either one of the fumble labels or one of the interception labels, provided he or she is required by rules of the dart game to use the second random selection means.

An auto-sensing non-standard dartboard with dart sensing means where scores are automatically tallied is disclosed. A computer-driven variation with a virtualized dartboard and cards implementing the method to simulate a football game as disclosed herein is also disclosed.

BRIEF DESCRIPTION OF THE DRAWINGS

The description herein makes reference to the accompanying drawings wherein like reference numerals refer to like parts throughout the several views and wherein:

FIG. 5B shows a front view of another exemplary RED ZONE card.

Similar reference numerals have been used in different figures to denote similar objects.

DETAILED DESCRIPTION OF THE ILLUSTRATIVE EMBODIMENT

The present invention is a game combining darts, a game board, a non-standard dartboard, and non-standard cards to simulate a football game.

Figure 1:
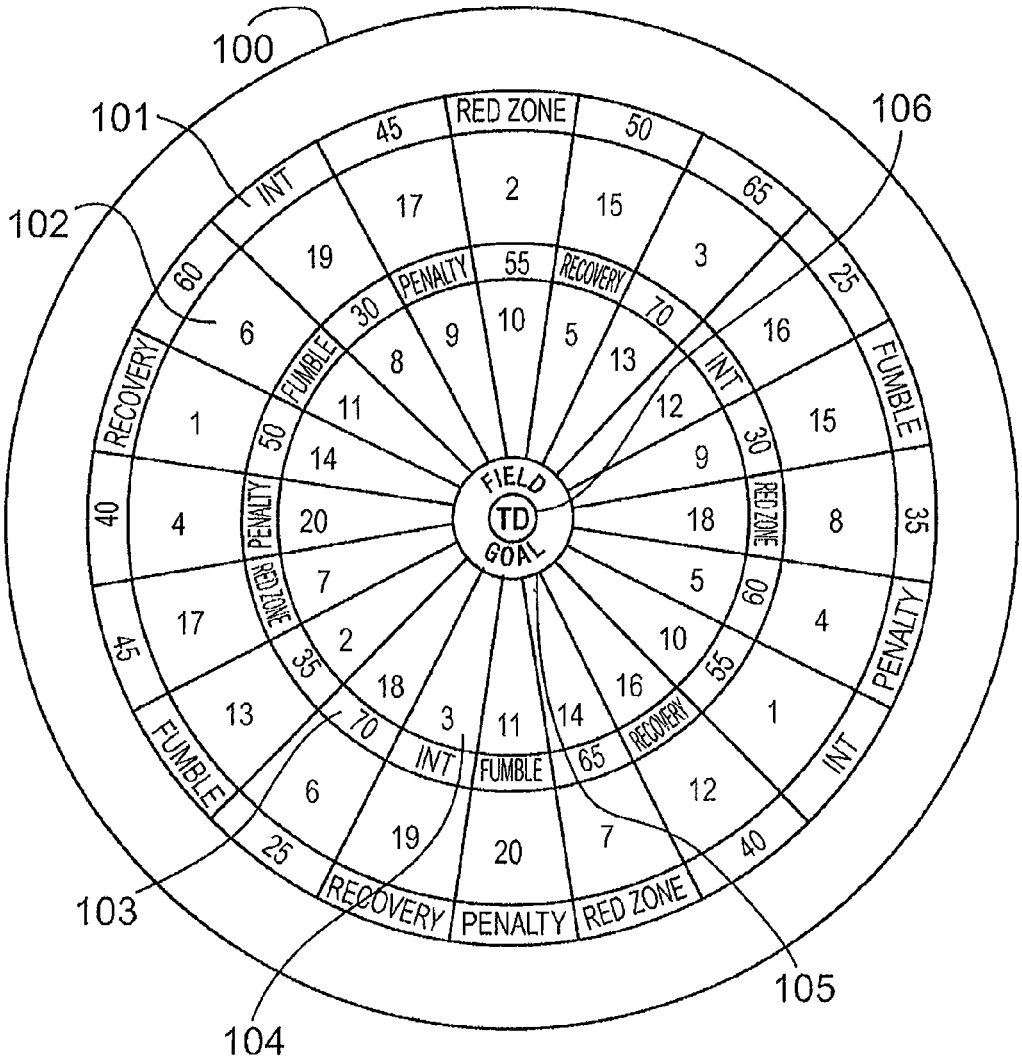
FIG. 1 shows a front view of a non-standard dartboard constructed according to the present disclosure.

Referring to FIG. 1, a front view of a first embodiment of a non-standard dartboard 100 is shown. This non-standard dartboard forms a circular region or target area 100 that can extend to the circular edge of the board. The circular region 100 receives darts thrown by a player. Circular region 100 can include multiple rings and multiple scoring regions. A single ring can also include multiple scoring regions. In exemplary circular region 100, a center scoring region is formed by primary scoring region 106 and secondary center scoring region 105. The center scoring region is surrounded by a first ring 104. Ring 104 is surrounded by a narrow second ring 103. Ring 103 is surrounded by a wide third ring 102, and the ring 102 is surrounded by another narrow fourth ring 101. Each ring comprises multiple scoring regions. In the embodiment shown, there are twenty scoring regions in each of the rings 101 to 104.

It can be appreciated that the number of rings or scoring regions can vary from the example shown in FIG. 1. For example, the center scoring region may be a single scoring region instead of being formed by primary center scoring region 106 and secondary center scoring region 105 as in the example in FIG. 1. The center scoring region can also be a formed by more than two scoring regions, for example a primary center scoring region, a secondary center scoring region, and a tertiary center scoring region.

It can also be appreciated that each different ring 101 to 104 or scoring region 105 to 106 can differ in size and area, in color, and in their ability to hold or retain darts. For example, the center scoring region may be tiny compared to all other scoring regions. In another example, the first and third rings 104 and 102 can be small compared to the second and fourth rings 103 and 101; and they can all be bigger compared to the center scoring region. In yet another example, the center scoring region can be constructed so that a dart must be aimed within a certain narrow range of angles in order to stick and score a point. It can also be appreciated that the size, area, color, and ability to hold or retain darts can also vary within each ring or scoring region as well.

Referring still to FIG. 1, each scoring region in the region 100 is labeled with either a yardage target label or an alphabetic label denoting a state of play. The yardage target labels can be numeric or alphabetic, such as "10" or "ten". Alphabetic labels denoting a state of play can include "Red Zone", "Fumble", "Penalty", "Interception", "Recovery", "Field Goal", "Touch Down", or any abbreviation thereof. These states of plays simulate a football game and will be explained in a later section.

In exemplary circular region 100, each scoring region in the second ring 103 or the fourth ring 101 is labeled with either a yardage target label or an alphabetic label denoting a state of play. Each scoring region in the first ring 104 or the third ring 102 are only labeled with a yardage target label. It can be appreciated that a ring may comprise any combination of yardage target labels or alphabetic labels denoting a state of play. It can also be appreciated that a ring may comprise only alphabetic labels denoting a state of play or only yardage target labels.

Figure 2:
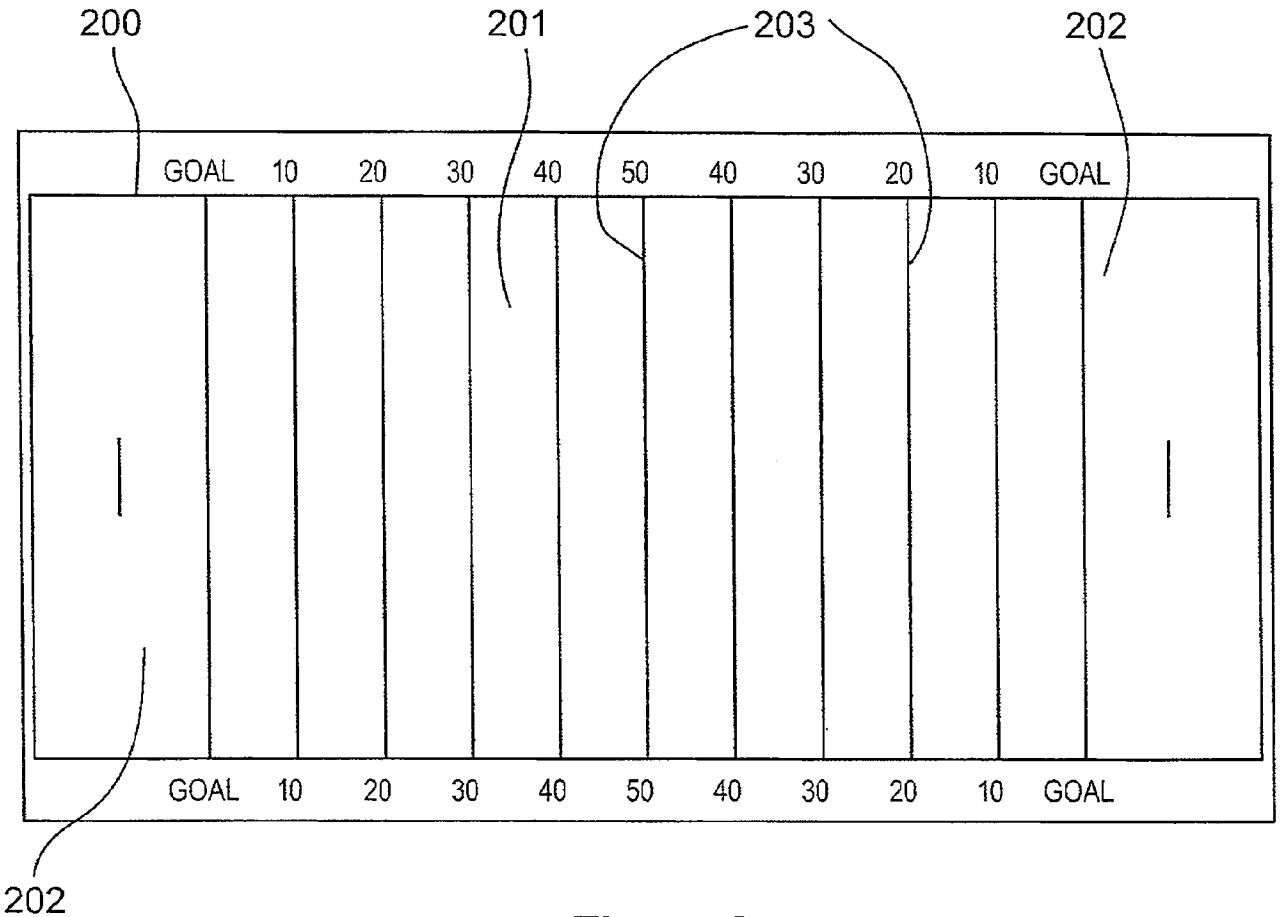
FIG. 2 shows a top view of an exemplary game board.

Referring now to FIG. 2, an exemplary game board 200 featuring a simulated football field 201 is shown. Similar to FIG. 1, a game board can also include optional decorations such as logos, pictures, slogans or other title elements. The simulated football field 201 features field or yardage markings 203 and at least one endzone 202. The exemplary board shown has two endzones 202 at opposite ends of the field. A player's progress down the game board 200 can be marked with any suitable playing piece (not shown), or can be marked with any other readily available place-holders, such as a coin or a peanut. A playing piece can be in the form of a small figure depicting a football player, if desired.

Figure 8:
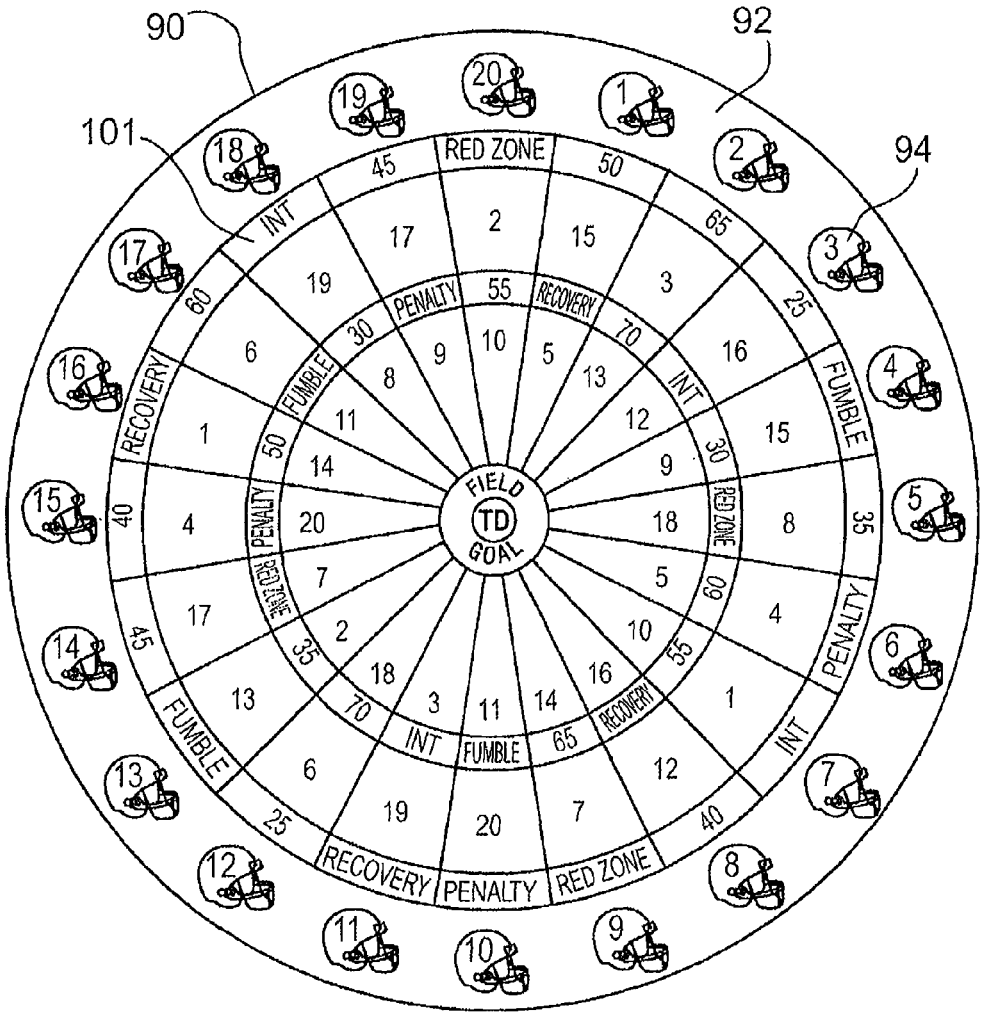
FIG. 8 is a front view of another embodiment of a dartboard constructed in accordance with the present disclosure.

An alternate form of non-standard dartboard 90 is shown in FIG. 8. This dartboard is similar in its construction and layout to the dartboard 100 of FIG. 1 except for the addition of an outer annular ring or area 92. The ring 92 is the outermost ring and is adjacent to the fourth ring 101. The ring 92 displays a series of consecutive numbers ranging from the number "1" to a maximum number corresponding to the total number of ring scoring regions in each of the rings 101 to 104 or in any one or more of these rings such as the second ring 103. These numbers can be placed on a football inspired design or pattern such as the illustrated football helmet 94. These designs can be identical (as shown) or can be different, e.g. to identify or signify different teams. In the illustrated board of FIG. 8, the numbers in the annular area range from 1 (near the top of the board) to 20 at the top of the board. The purpose of these numbers is to make it clearer to the players which scoring region they are required to hit with a dart during the play of the game. How players are provided with their strike number is explained below.

Some exemplary non-standard cards will now be discussed.

Figure 3:
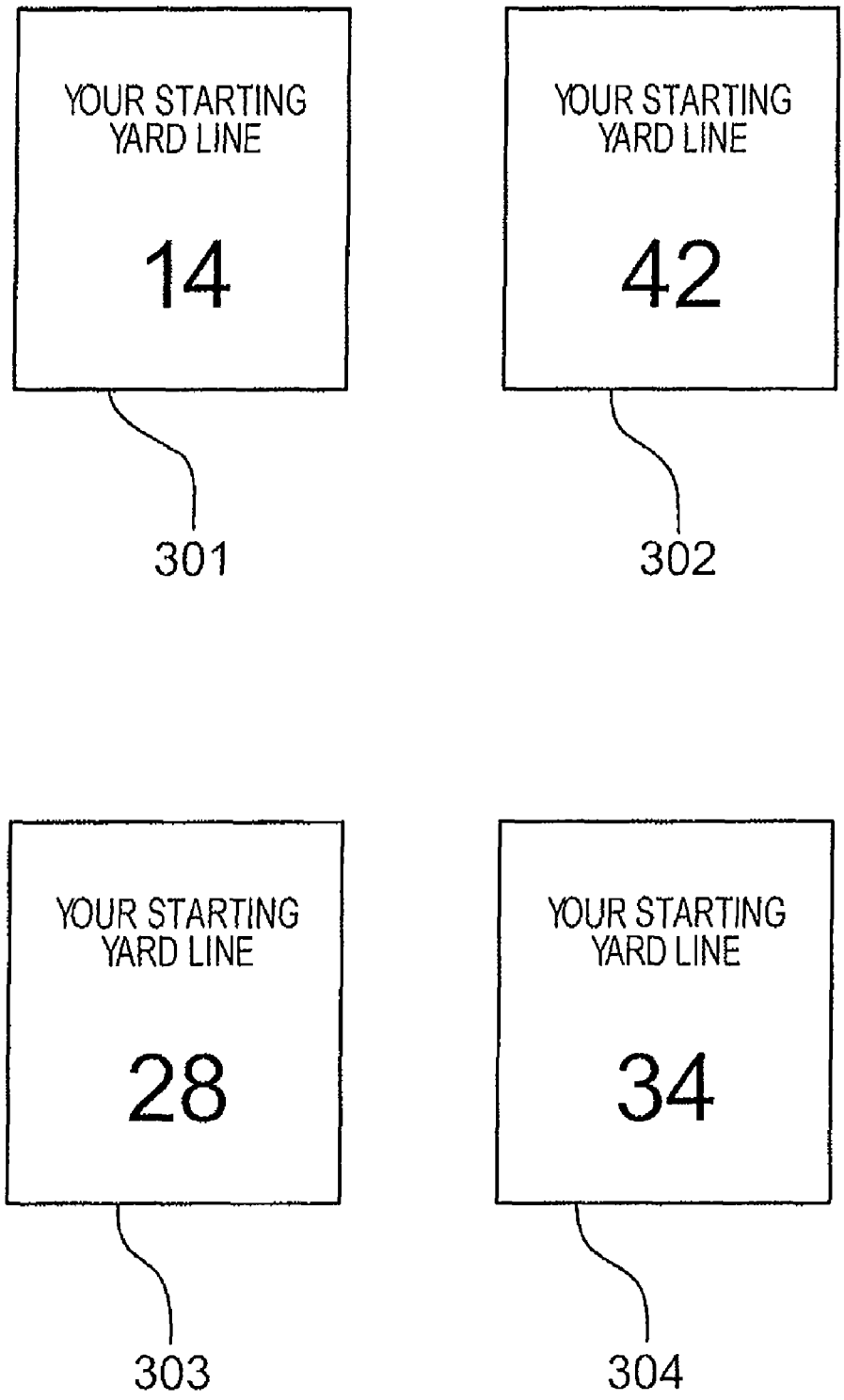
FIG. 3 shows a front view of four STARTING YARDLINE cards.

Referring now to FIG. 3, the front view of four exemplary STARTING YARDLINE cards are shown. Each STARTING YARDLINE card 301 to 304 contains a starting yard line for a player. While STARTING YARDLINE cards 301 to 304 each contain a numeric starting yard line, it is contemplated that a STARTING YARDLINE line may be conveyed by words, such as "ten" instead of "10" as well. It can also be appreciated that while STARTING YARDLINE card 301 to 304 each contain the text "Your Starting Yard Line", this text may be changed to any text or picture that helps a player differentiate a STARTING YARDLINE card from another type of card. Alternatively, text or picture describing the card itself may also be omitted and the type of card distinguished by its color or size, for example.

It can be appreciated that the range of values for a STARTING YARDLINE card may not exceed the maximum length of simulated football field 201.

Figure 4A:
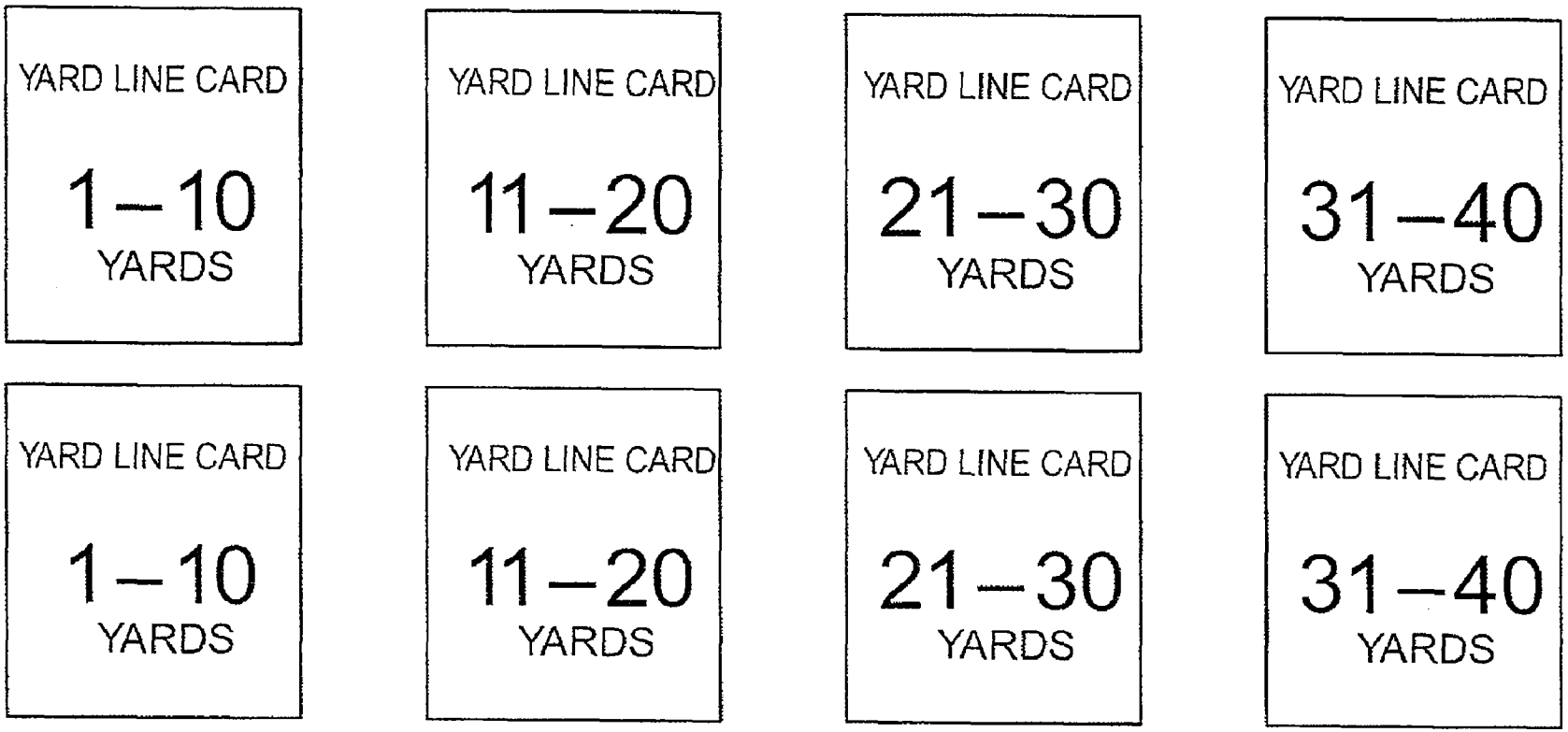
FIG. 4A shows a back view of an exemplary set of YARD LINE cards.

Referring now to FIG. 4A, a back view of an exemplary set of YARD LINE cards are shown. The exemplary set of YARD LINE cards are divided into 8 different yard range types, from "1-10 Yards", "11-20 Yards", "21-30 Yards", "31-40 Yards", "41-50 Yards", "50-41 Yards", "40-31 Yards", and "30-21 Yards". While it is preferred that the total number of yard range type of YARD LINE cards consist of 20 individual YARD LINE cards, it can be appreciated that the actual number of yard range type of YARD LINE cards may vary.

Each different yard range type of YARD LINE cards corresponds to a player's position on the simulated football field 201. Thus, if a player's position on the simulated football field 201 is at the 15 yard line, he would pick a YARD LINE card with a back face of "11-20 Yards". The method to simulate a football game will be described in detail in a later section.

Figure 4B:
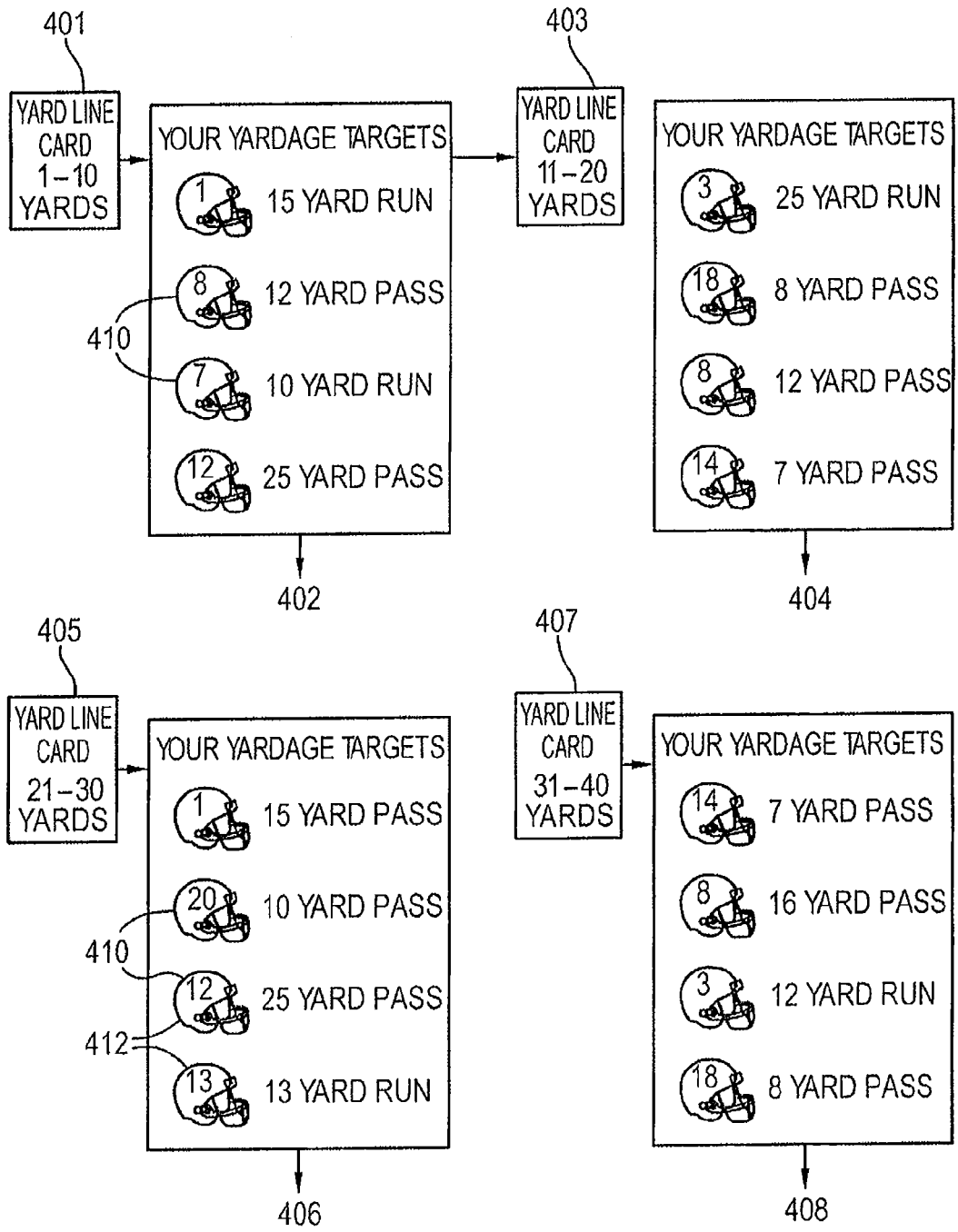
FIG. 4B shows a front view of four exemplary YARD LINE cards.

Referring now to FIG. 4B, a front view of 4 exemplary YARD LINE cards are shown. Back card face 401 is the back view of an exemplary "1-10 Yards" YARD LINE card, and front card face 402 is the corresponding front view of the same "1-10 Yards" YARD LINE card. Back card face 403 is the back view of an exemplary "11-20 Yards" YARD LINE card, and front card face 404 is the corresponding front view of the same "11-20 Yards" YARD LINE card. Back card face 405 is the back view of an exemplary "21-30 Yards" YARD LINE card, and front card face 406 is the corresponding front view of the same "21-30 Yards" YARD LINE card. Back card face 407 is the back view of another exemplary "21-30 Yards" YARD LINE card, and front card face 408 is its corresponding front view. These exemplary cards are made for use with the dartboard 90 shown in FIG. 8.

Referring to front card faces 402, 404, 406, and 408, four yardage targets are shown on each card. Each yardage target represents a football play, or four "downs". It is preferred that each of the four yardage targets on the same card be unique (i.e. yardage targets on the same card are different from each other) and that all yardage targets are distributed at random (within the constraints described herein), although this does not necessarily need to be the case.

It is preferred that the sum of the yardage targets shown on the front card face of each YARD LINE card be less than the yardage required for the player to reach the endzone taking into account the player's starting yard line (which is within the range indicated on the back face). Thus, no single YARD LINE card will give a player the amount of yards they need to get to the endzone of the opposing team, as the following example will help illustrate.

Exemplary simulated football field 201 is 100 yards long. The red zone is the area between the 20 yard line and the goal of the opposing team. Thus, a player on his own 15 yard line must travel another 85 yards to reach the endzone. As described above, this player would pick a YARD LINE card with a back face of "11-20 Yards". Looking at front card face 402 (which is a YARD LINE card with a back face of "1-10 Yards"), four yardage targets are shown: 15 Yards, 12 Yards, 10 Yards, and 25 Yards. The sum of the 4 yardage targets is 62 Yards (15+12+10+25=62 Yards), which is less than the 85 yards the player must travel to reach the endzone of the opposing team.

In another example, consider a player on the 25 yard line of the 100 yard line simulated football field 201. He must travel another 75 yards to reach the endzone of the opposing team. As described above, this player would pick a YARD LINE card 405 with a back face of "21-30 Yards". Looking at front card face 406 (which is a YARD LINE card with a back face of "21-30 Yards"), four yardage targets are shown: 15 Yards, 10 Yards, 25 Yards, and 13 Yards. The sum of the four yardage targets is 67 Yards (15+10+25+13=63 Yards), which is less than the 75 yards the player must travel to reach the endzone of the opposing team.

In summary, a "1-10 Yards" YARD LINE card 401 will not contain yardage targets with a sum of more than 90 yards. An "11-20 Yards" YARD LINE card will not contain yardage targets with a sum of more than 80 yards. A "21-30 Yards" YARD LINE card will not contain yardage targets with a sum of more than 70 yards. A "31-40 Yards" YARD LINE card will not contain yardage targets with a sum of more than 60 yards. A "41-50 Yards" YARD LINE card will not contain yardage targets with a sum of more than 50 yards. A "50-41 Yards" YARD LINE card will not contain yardage targets with a sum of more than 41 yards. A "40-31 Yards" YARD LINE card will not contain yardage targets with a sum of more than 31 yards. A "30-21 Yards" YARD LINE card will not contain yardage targets with a sum of more than 21 yards.

An optional feature of the YARD LINE cards is the provision of the additional four numbers indicated at 410. These numbers which can be arranged on the left side of the front card face 402 to 408 are used when the dartboard 90 is being used. These numbers indicate to the player the pie-shaped section of the target region that contains the required yardage target. Because these numbers are arranged in numerical order around the dartboard they are relatively easy to see and locate, even from several yards away. The additional numbers 410 are not required for and are not used with the dartboard of FIG. 1. The numbers 410 can each be printed on football inspired design or pattern such as the illustrated football helmets 412. Desirably these designs can correspond to those used on the dartboard itself.

It will be appreciated that instead of a deck of Yard Line cards, other forms of random selection devices can be used to provide in a random manner a set of yardage targets to be achieved by each player on his or her turn for throwing a dart or darts. Manual forms of random selection devices include one or more dice, spinning arrows or pointers mounted on a card having a series of yardage numbers printed thereon, and various electronic devices such as a personal computer programmed to produce a random yardage number or a set of yardage numbers.

Figure 5A:
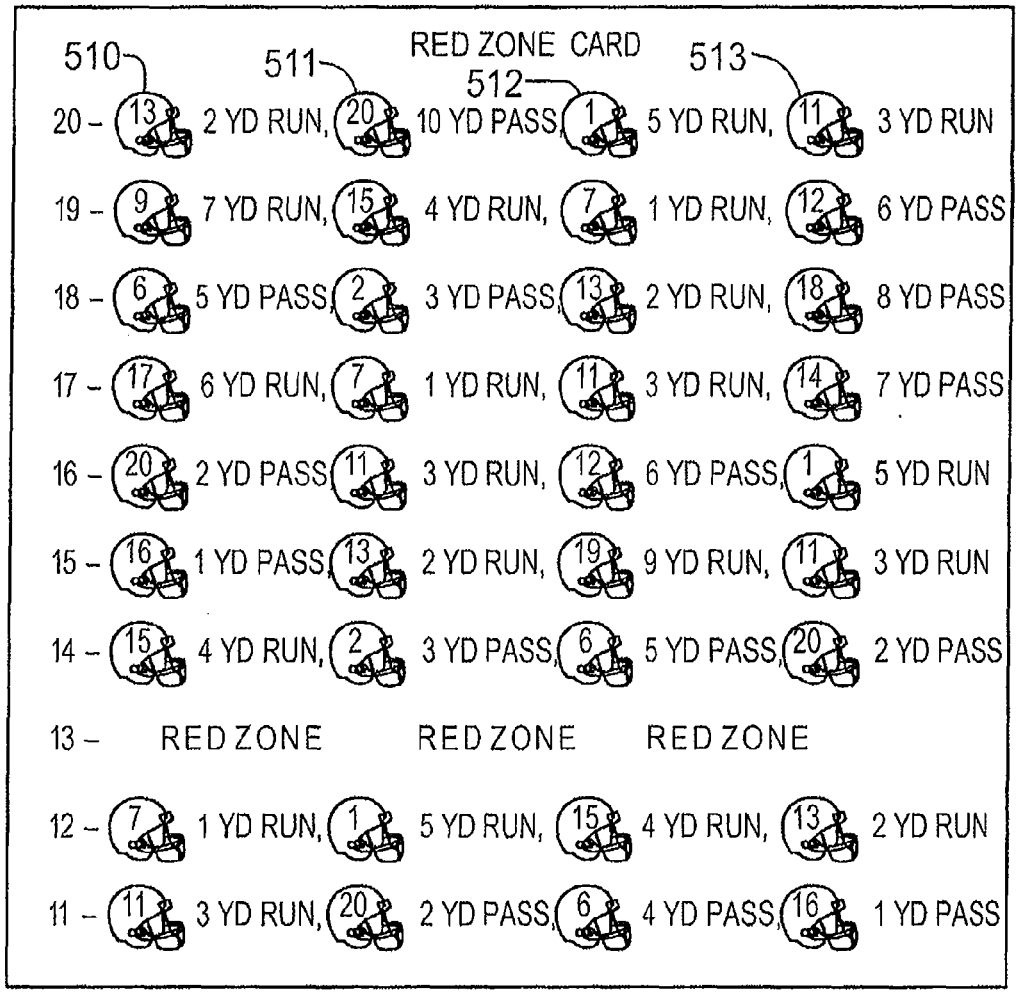
FIG. 5A shows a front view of an exemplary RED ZONE card.

Referring now to FIG. 5A, a front view of an exemplary RED ZONE card is shown. RED ZONE cards contain a series of yardage targets, or football "plays", for a player who is in the red zone (the 20 yard line to the 11 yard line of the opposing team).

With reference to the exemplary RED ZONE card of FIG. 5A, if a player is on the 20 yard line, his yardage targets (football "plays"), are 2 yards, 10 yards, 5 yards, and 3 yards. In another example, if a player is on the 11 yard line, his yardage targets (football "plays") are 3 yards, 2 yards, 4 yards, and 1 yard. If a player is on the 13 yard line, he enters a red zone state of play. States of play will be discussed in more detail in a later section.

Referring now to FIG. 5B, a front view of another exemplary RED ZONE card is shown. If a player is on the 20 yard line, his yardage targets (football "plays"), are 4 yards, 7 yards, 5 yards, and 3 yards. In another example, if a player is on the 11 yard line, his yardage targets (football "plays") are 4 yards, 2 yards, 3 yards, and 1 yard. If a player is on the 17 yard line, he enters a red zone state of play.

An exemplary version of the game apparatus has at least 20 RED ZONE cards, although it can be appreciated that the total number of RED ZONE cards can vary. Given 20 RED ZONE cards, it is also preferable for a red zone state of play to appear 2 times for each yard line across the 20 RED ZONE cards. For example, a red zone state of play should appear on the 13 yard line (as in FIG. 5A) on only 2 RED ZONE cards out of all 20 RED ZONE cards. Similar to the YARD LINE cards, each RED ZONE card is preferably unique and the yardage targets distributed at random (within the constraints described herein). Again it will be understood that instead of a stack of Red Zone cards, other forms of random selection devices can be used to provide in a random manner a set of yardage targets to be achieved by each player after reaching the endzone. Such random selection devices can include dice, spinning arrows or pointers mounted on a card or another flat surface having a series of suitable numbers printed or formed thereon, and various possible electronic devices, including a personal computer programmed to produce the required random number or numbers.

An optional feature of the RED ZONE cards is the provision of the additional four numbers 510 to 513 in each horizontal row on the card. These numbers can be provided in nine of the rows representing the various yard lines that the player may be on. They are not present on the RED ZONE line. These extra numbers are used when the dartboard 90 of FIG. 8 is being used and they are not required or used if the dartboard of FIG. 1 is being used. Again, these numbers 510 to 513 indicate to the player the pie-shaped section of the target region that contains the required yardage amount that he or she must aim for.

Each STARTING YARDLINE, YARD LINE, or RED ZONE card contains numbers denoting a starting yard line or yardage targets. While the cards shown in FIGS. 3, 4A, 4B, 5A, 5B each contains numbers, it is contemplated that a card may use words instead of numbers to indicate the number of yards, such as using "ten" instead of "10". It can also be appreciated that while the cards in FIGS. 3, 4A, 4B, 5A, 5B each contain text to describe the card, this text can be any suitable text or picture that helps a player differentiate one type of card from another type of card. Alternatively, text or picture describing the card itself may also be omitted and the type of card indicated by its color or size or both.

Figure 6:
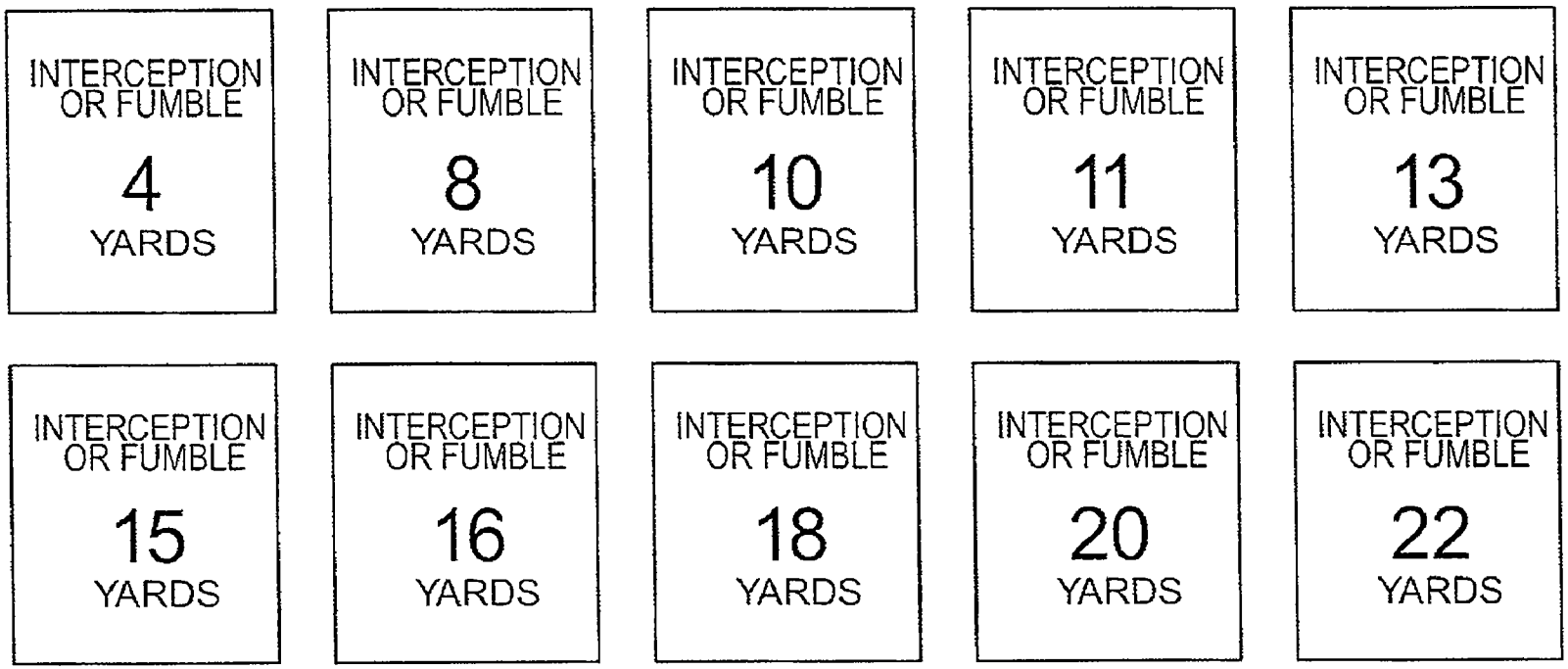
FIG. 6 shows a front view of an exemplary set of 10 INTERCEPTION/FUMBLE cards.

Referring now to FIG. 6, a front view of an exemplary set of 10 INTERCEPTION/FUMBLE cards is shown. Each INTERCEPTION/FUMBLE card contains a number denoting the number of yards that an interception or a fumble has cost a player. While the INTERCEPTION/FUMBLE cards shown in FIG. 6 each contain a number, it is contemplated that a INTERCEPTION/FUMBLE card may use words instead of numbers to indicate the number of yards that an interception or a fumble has cost a player, such as using "ten" instead of "10". It can also be appreciated that while the INTERCEPTION/FUMBLE cards in FIG. 6 each contain the text "Interception or Fumble", this text may be changed to any text, picture or color that helps a player differentiate a INTERCEPTION/FUMBLE card from another type of card. Alternatively, text or picture describing the card itself may also be omitted.

Similar to the YARD LINE and RED ZONE cards, each INTERCEPTION/FUMBLE card is preferably unique and the yardage distributed at random. Again instead of a set of Interception/Fumble cards, other forms of random selection devices can be used to provide in a random manner a yardage amount that an interception or fumble has cost a player. Manual forms of random selection devices can include a die or dice, spinning arrows or pointers mounted on a card or other surface having a series of yardage numbers printed thereon, and electronic devices.

Figure 7:
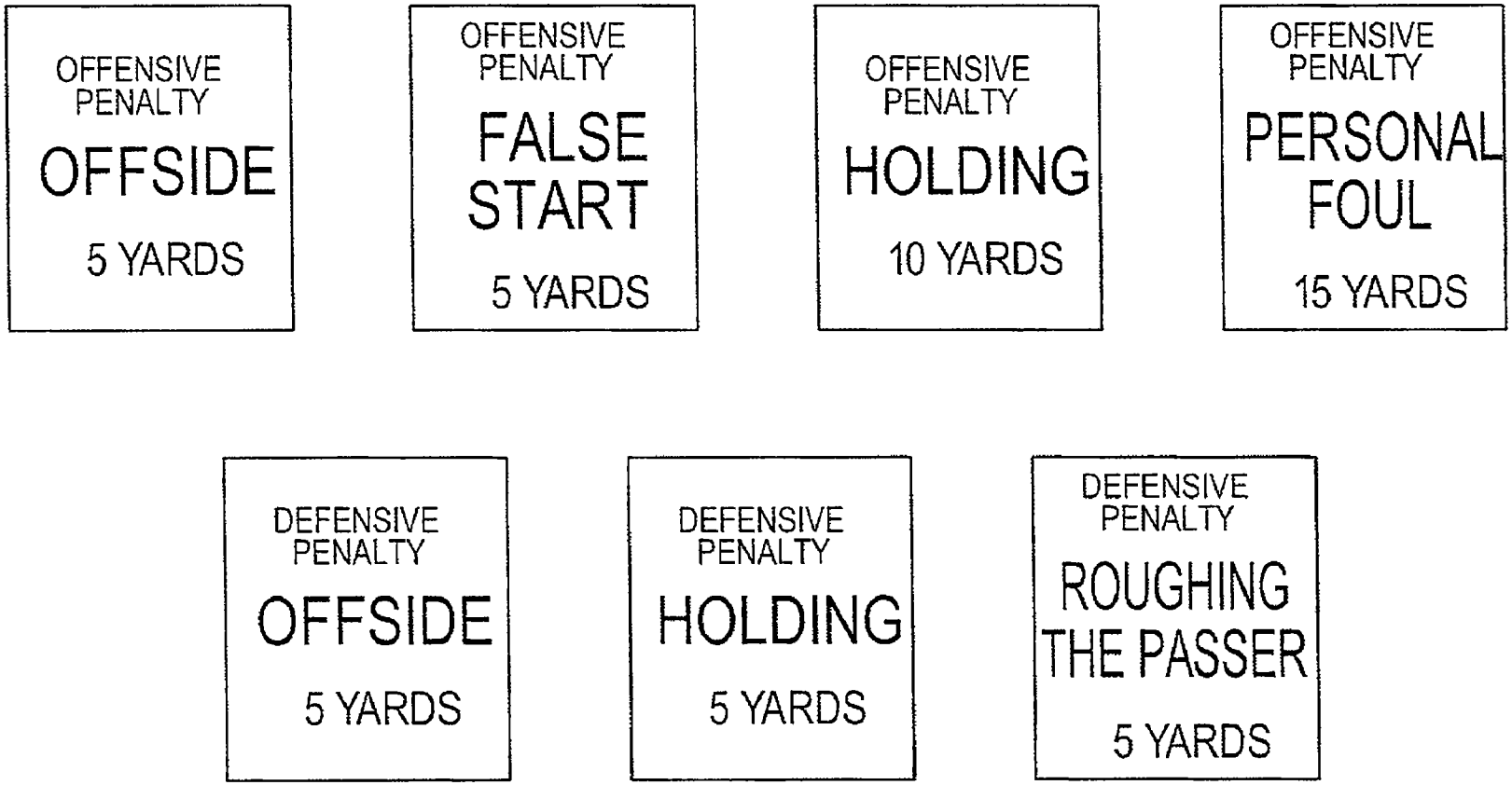
FIG. 7 shows a front view of 7 exemplary PENALTY cards.

Referring now to FIG. 7, a front view of seven exemplary PENALTY cards is shown. There are preferably ten PENALTY cards in total, distributed as seven offensive PENALTY cards and three defensive PENALTY cards. As shown in FIG. 7, a set of PENALTY cards preferably contains one Offensive Offside PENALTY card associated with a 5 yard penalty, two Offensive False Start PENALTY cards each associated with a 5 yard penalty, two Offensive Holding PENALTY cards each associated with a 10 yard penalty, two Offensive Personal Foul PENALTY cards each associated with a 15 yard penalty, one Defensive Offside PENALTY card associated with a 5 yard penalty, one Defensive Holding PENALTY card associated with a 5 yard penalty, and one Defensive Roughing the Passer PENALTY card associated with a 10 yard penalty.

Figure 9:
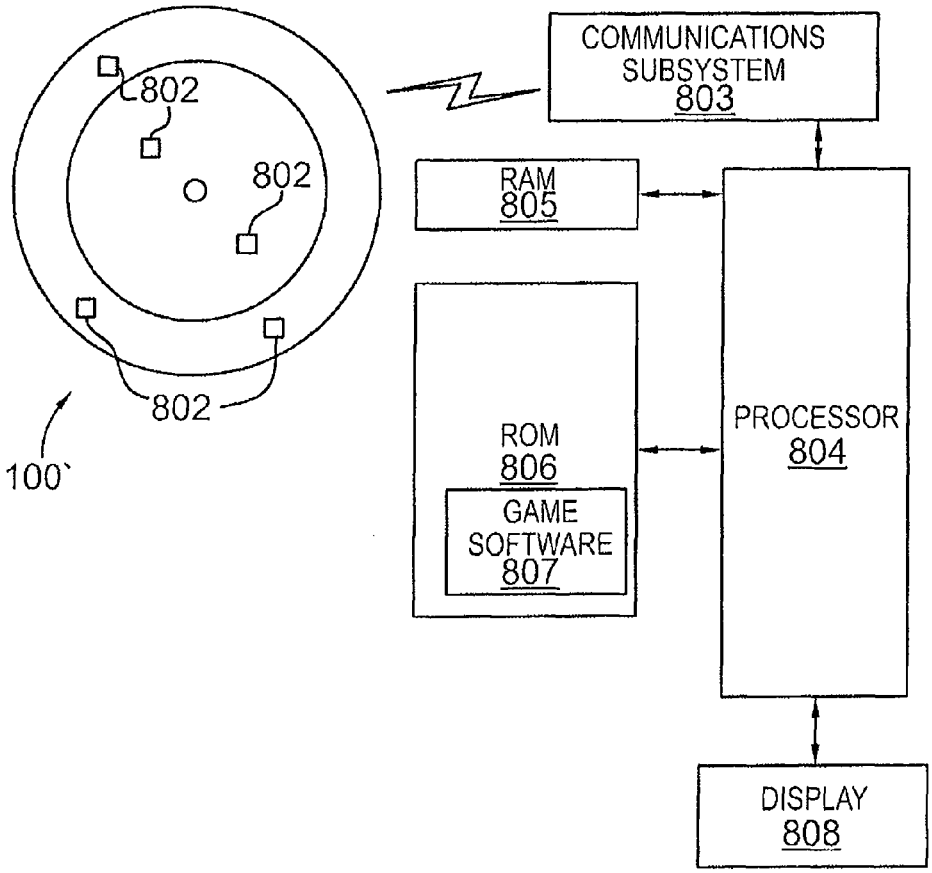
FIG. 9 shows a block view of the exemplary non-standard dartboard with dart sensing means.

Referring to FIG. 9, an exemplary non-standard dartboard 100' is shown with dart sensing means 802, such as pressure sensors or proximity sensors which are sensitive to the presence of darts. Dart sensing means 802 are linked to a processor 804 by a communications subsystem 803, which may be a wireless system or a wired system. Processor 804 also includes interfaces with ROM 806, RAM 805, and display 808.

ROM 806, which may also comprise flash memory, contains an operating system and game software 807. ROM 806 also includes instructions to control display 808 and accept input and output from communications subsystem 803.

It can be appreciated that game software 807 may be implemented as a separate application running under an operating system or it may be implemented as a single piece of firmware. It can also be appreciated that the operating system or the game software 807, or the firmware image, or parts thereof, may be temporarily loaded into volatile storage such as RAM 805. Received communications signals may also be stored to volatile or non volatile storage.

In operation, communications system 803 receives signals from dart sensing means 802 regarding the presence and the position of darts on non-standard dartboard 100'. These signals are transferred to processor 804, which processes the signals according to the game software 807 and tallies a score, which is shown on display 808.

A method to simulate a football game using four darts, a non-standard dartboard 100, a game board 200, a set of twenty STARTING YARDLINE cards, a set of YARD LINE cards, a set of twenty RED ZONE cards, the set of INTERCEPTION/FUMBLE cards of FIG. 6, and a set of ten PENALTY cards will now be described.

To start, each player chooses a playing piece and a rotation of player turns is determined. In a two player game, this may be done via a coin flip. Each player chooses a STARTING YARDLINE card, and positions his playing piece on the game board 200 according to their STARTING YARDLINE card.

A player selects a YARD LINE card corresponding to his playing piece's position on the game board 200. For example, if the player drew a STARTING YARDLINE card of 15 yards, he will draw a YARD LINE card with "11-20 Yards" on its back face. For this example, the player drew a YARD LINE card with the front face 404 of FIG. 4B.

According to front face 404, the player has the following yardage targets, or football "plays" or football "downs": 25 yards, 8 yards, 12 yards, and 7 yards. For each of the yardage targets, there exists at least one scoring region on non-standard dartboard 100 with a corresponding yardage target label. Thus, for the first yardage target of 25 yards, the player aims a dart towards a scoring region on non-standard dartboard 100 with a yardage target label of "25". For the second yardage target of 8 yards, the player aims a dart towards a scoring region on non-standard dartboard 100 with a yardage target label of "8". For the third yardage target of 12 yards, the player aims a dart towards a scoring region on non-standard dartboard 100 with a yardage target label of "12". For the fourth yardage target of 7 yards, the player aims a dart towards a scoring region on non-standard dartboard 100 with a yardage target label of "7".

In general, for each dart that is properly positioned in its corresponding scoring region, the player may move his game piece on game board 200 accordingly. Thus, if the player properly positions his first dart on a scoring region labeled "25", his second dart on a scoring region labeled "8", his third dart on a scoring region labeled "12", and his fourth dart on a scoring region labeled "7", he may move his playing piece on gaming board 200 forward by 52 yards (25+8+12+7=52 yards) ahead.

The player may make one attempt for each of the 4 yardage targets. If a player misses, the yardage target, football "play", "down", or "run" is considered incomplete.

In the course of attempting to properly position his dart on a yardage target, if a dart ends up being positioned in a scoring region labeled with a PENALTY state of play, the player draws a PENALTY card and the penalty shown on the card is allocated to the player. For example, if the player draws an Offensive Offside PENALTY card associated with a 5 yard penalty, the playing piece of that player is moved back 5 yards on game board 200. Play then resumes with the next dart, with the player attempting to properly position his remaining darts onto the appropriate scoring regions as indicated by his YARD LINE card. For example, if the player positions his third dart onto a scoring region labeled with a PENALTY state of play, the next dart for the player will be his fourth dart, aiming for a scoring region labeled "7".

In the course of attempting to properly position his dart on a yardage target, if a dart ends up being positioned in a scoring region labeled with a FUMBLE state of play or an INTERCEPTION state of play, the player must use one of his remaining darts and attempt to properly position it onto a scoring region labeled with a RECOVERY state of play. If the player positioned his fourth dart onto a scoring region labeled with a FUMBLE state of play or an INTERCEPTION state of play (and hence has no more darts for RECOVERY), the player is given one extra dart and he must position it onto a scoring region labeled with a RECOVERY state of play.

If the player fails to properly position at least one of his remaining darts onto a RECOVERY state of play, the player must draw an INTERCEPTION/FUMBLE card, and move his playing piece to the starting position indicated by the INTERCEPTION/FUMBLE card. The player's turn ends whether or not he has finished all four of his yardage targets indicated by his YARD LINE card.

If the player manages to properly position at least one of his remaining darts onto a RECOVERY state of play, the player may resume attempting to properly position his dart on the next yardage target. For example, if the player hits FUMBLE with his first dart and hits RECOVERY with his second dart, play resumes with the third dart, which must be properly positioned in a scoring region labeled "12".

As mentioned above, the sum of all four yardage targets on a single YARD LINE card is insufficient for a player to reach the endzone 202. Play continues as each player draws a new YARD LINE card and attempts to properly position his 4 darts as indicated by the yardage targets.

A player whose previous turn ended with his playing piece within the red zone 202 but more than 10 yards away from a touchdown draws a RED ZONE card. For example, a player whose turn starts at the 17 yard line of the defense draws a RED ZONE card. In this example, the player drew the RED ZONE card of FIG. 5A. Referring now to the corresponding row "17 6 yds, 1 yd, 3 yds, 7 yds" on FIG. 5A, the player must properly position the first of his four darts onto a scoring region labeled "6", the second of his four darts onto a scoring region labeled "1", the third of his four darts onto a scoring region labeled "3", and the fourth of his four darts onto a scoring region labeled "7". Any darts properly positioned thusly will entitle the player to advance his game piece on game board 200 respectively. In the course of attempting to properly position his darts, if the player instead positions his darts in a scoring region labeled with a state of play of PENALTY, FUMBLE, or INTERCEPTION, the same procedure as explained above applies. If the player who draws a Red Zone card is on the yardage labeled RED ZONE, then the player is required to hit a Red Zone scoring region on the dart board to be able to go for a score.

In another example, a player whose turn starts at the 13 line of defense draws a RED ZONE card of FIG. 5B. Referring now to the corresponding row for line 13 in FIG. 5B, the player may advance his game piece on game board 200 to the zero yard line. Once the player has moved his game piece to the zero yard line of the defense, he is provided with 4 darts. With these 4 darts the player attempts to properly position them within the primary center scoring region 106 ("TD", or Touchdown) or the secondary center scoring region 105 ("FIELDGOAL").

For each dart that the player manages to properly position within the primary center scoring region 106 ("TD"), he is awarded 7 points. If the player manages to properly position 1 dart within the primary center scoring region 106 ("TD") and properly positions 1 dart within the secondary scoring region 105 ("FIELDGOAL"), he is awarded 8 points. If the player manages to properly position 2 darts within the secondary scoring region 105 ("FIELDGOAL"), he is awarded 6 points. If the player manages to properly position all 3 darts within the secondary scoring region 105 ("FIELDGOAL"), he is awarded 7 points.

Once his four darts have been thrown, play is turned over to the next player. Regardless of whether or not a score was accrued, the next turn of that player must commence with a STARTING YARDLINE card.

If a player positions a dart in a scoring region labeled with a RED ZONE state of play, the primary center scoring region 106 or secondary center scoring region 105 when a dart is not expected to be placed in those scoring regions, the player is not rewarded with a score.

A numerical tally is maintained of all the points collected by each player. A winner is determined based on the most points accumulated within a preset period of time.

While a card-based game is described above, it is also contemplated that the game as described above may be implemented on a computer or a PDA, which randomizes the yardage targets and plays more fully than is capable through fixed cards. Such an electronic game is capable of computing and presenting the various outcomes on a display. This computer or PDA may also optionally be linked to a dartboard with dart sensing means as in FIG. 8.

Certain adaptations and modifications of the described embodiments can be made. Therefore, the above discussed embodiments are considered to be illustrative and not restrictive. While variants have been described in detail in the foregoing specification, it will be understood by those skilled in the art that variations may be made without departing from the scope of the application, being limited only by the appended claims.

The invention claimed is:

1. Dart game apparatus for simulating a football game using darts to be thrown by players, said dart game apparatus comprising:

a dart board on which is formed a target region capable of receiving and holding darts thrown by a player, said target region being divided into a center scoring region located at the center of the target region and at least first and second concentric rings surrounding the center scoring region, said first ring being divided into a plurality of first ring scoring regions and said second ring being divided into a plurality of second ring scoring regions;

a plurality of yardage target labels provided on said target region;

a plurality of alphabetic labels provided on said target region, each alphabetic label denoting a state of play related to the simulated football game; and a plurality of yard line cards indicating on one side of each card a yard range on a simulated football field corresponding to a player's position on this football field and on an opposite side of each card a plurality of yardage targets to be achieved by the player, who has selected that particular card, by means of darts thrown at said dart board, wherein each of said first and second ring scoring regions displays either one of said yardage target labels or one of said alphabetic labels.

2. Dart game apparatus according to claim 1 including a third concentric ring surrounding the center scoring region and divided into a plurality of third ring scoring regions, each third ring scoring region displaying one of said yardage target labels.

3. Dart game apparatus according to claim 2 wherein said third concentric ring is adjacent the center scoring region, extends radially outwardly from the center scoring region, and is surrounded by the first and second concentric rings.

4. Dart game apparatus according to claim 3 including a fourth concentric ring surrounding the center scoring region and divided into a plurality of fourth ring scoring regions, each fourth ring scoring region displaying one of said yardage target labels.

5. Dart game apparatus according to claim 4 wherein said fourth concentric ring is located between said first and second concentric rings and at least some of said first ring scoring regions and at least some of said second ring scoring regions display said alphabetic labels.

6. Dart game apparatus according to claim 1 wherein each yard line card has four yardage targets on said opposite side of the card.

7. Dart game apparatus according to claim 1 including a game board displaying a representation of a football field including at least one end zone.

8. Dart game apparatus according to claim 7 including a second set of cards each containing a plurality of yardage targets for at least most possible player yardages between 11 and 20 on said football field, wherein during play of a dart game with said dart game apparatus, a player who reaches a yardage location on said football field between and including yardages 11 and 20 draws one of said second set of cards to determine his yardage targets to advance towards an opponent's end zone.

9. Dart game apparatus according to claim 8 wherein each card of said second set has a unique state of play indication for one of the possible player yardages between 11 and 20, this state of play being indicated by some of said alphabetic labels on the dart board.

10. Dart game apparatus according to claim 2 including an outermost ring on said dartboard displaying a series of consecutive numbers ranging from the number one to a maximum number corresponding to the total number of said second ring scoring regions.

11. Dart game apparatus according to claim 8 wherein some of said alphabetic labels denote a fumble state of play and some of said alphabetic labels denote an interception state of play and said apparatus includes a third set of cards each indicating a starting yardage position to which a player must move during play of the dart game after the player hits one of said scoring regions with either one of the fumble labels or one of the interception labels and he or she is required by rules of the dart game to draw one of said third set of cards.

12. Dart game apparatus according to claim 8 wherein some of the alphabetic labels denote a penalty state of play and said apparatus includes a further set of cards each indicating a yardage penalty which a player incurs during play of the dart game after the player hits one of said scoring regions with a penalty label and is forced by rules of the dart game to draw one of said further set of cards.

13. Dart game apparatus for simulating a football game using darts to be thrown by players, said dart game apparatus comprising:

a dart target on which is provided a target area capable of holding the darts thrown by each player, said target area being divided into a center scoring region located centrally on said target area and at least first and second concentric rings surrounding the central scoring region, the first ring being divided into a plurality of first ring scoring regions arranged around the first ring and the second ring being divided into a plurality of second ring scoring regions arranged around the second ring;

a plurality of yardage target labels provided on said target area;

a plurality of alphabetic labels provided on said target area and denoting states of play related to the simulated football game, each of said first and second ring scoring regions displaying either one of said yardage target labels or one of said alphabetic labels; and random selection means for providing in a random manner a set of yardage targets to be achieved by each player on his or her turn for throwing a dart or darts at said target.

14. Dart game apparatus according to claim 13 wherein said random selection means is a deck of cards, each card indicating on a first side of the card a yard range on a simulated football field corresponding to a player's position on this football field and indicating on a rear side a plurality of yardage targets to be achieved by throwing darts at said dart target.

15. Dart game apparatus according to claim 13 wherein said random selection means is a computer programmed to generate said set of yardage targets in a random manner, the sum total of said yardage targets in each generated set not exceeding the distance from the particular player's current position on a simulated football field to an opposing player's end zone.

16. Dart game apparatus according to claim 13 including an outermost annular area on said dart target displaying a series of consecutive numbers ranging from the number one to a maximum number corresponding to the total number of second ring scoring regions.

17. Dart game apparatus according to claim 13 including a third concentric ring surrounding the center scoring region and divided into a plurality of third ring scoring regions, each third ring scoring region displaying one of said yardage target labels.

18. Dart game apparatus according to claim 13 including additional random selection means for providing in a random manner sets of yardage targets for at least most possible player yardages between 11 and 20 on a simulated football field, wherein during play of a dart game with said apparatus, a player who reaches a yardage location on said football field between and including yardages 11 and 20 uses said additional random selection means to provide said sets of yardage targets to determine his or her yardage targets to advance towards an opponent's end zone on the football field.

19. Dart game apparatus for simulating a football game using darts to be thrown by players, said dart game apparatus comprising:

a dart target on which is provided a target area capable of holding darts thrown by each player, said target area being divided into a plurality of scoring regions;

a plurality of yardage target labels distributed over said target area;

a plurality of additional labels distributed over said target area denoting states of play related to the simulated football game, at least a majority of said scoring regions each having either one of said yardage target labels or one of said additional labels, some of said additional labels denoting a fumble state of play and some of said additional labels denoting an interception state of play;

first random selection means for providing in a random manner a set of yardage targets to be achieved by each player on his or her turn for throwing a dart or darts at said dart target; and second random selection means for providing in a random manner a starting yardage position to which a player must move during play of the game after the player hits one of the scoring regions with either one of the fumble labels or one of the interception labels and he or she is required by rules of the dart game to use said second random selection means.

20. Dart game apparatus according to claim 19 wherein said first random selection means is a first set of cards indicating on one side of each card a yard range on a simulated football field corresponding to a player's position on this football field and on an opposite side of each card said set of yardage targets to be achieved by the player by means of darts thrown at said dart target.

21. Dart game apparatus according to claim 20 including an outermost annular area on said dart target displaying a series of consecutive numbers ranging from the number one to a selected maximum number, wherein said target area includes at least first and second concentric rings each divided circumferentially into said scoring regions and the number of scoring regions in each ring corresponds to said selected maximum number.

22. Dart game apparatus according to claim 19 wherein said second random selection means is a set of cards and each card of said set displays a starting yardage position.

23. Dart game apparatus according to claim 19 including a game board displaying a representation of a football field including two end zones at opposite ends of the football field representation.

* * * * *